US008897676B2

(12) United States Patent
Nakaue et al.

(10) Patent No.: US 8,897,676 B2
(45) Date of Patent: Nov. 25, 2014

(54) IMAGE FORMING APPARATUS

(75) Inventors: Takahisa Nakaue, Osaka (JP); Takashi Morita, Osaka (JP); Tamotsu Shimizu, Osaka (JP); Teruhiko Nagashima, Osaka (JP)

(73) Assignee: Kyocera Document Solutions Inc., Osaka-shi (JP)

( * ) Notice: Subject to any disclaimer, the term of this patent is extended or adjusted under 35 U.S.C. 154(b) by 128 days.

(21) Appl. No.: 13/444,914

(22) Filed: Apr. 12, 2012

(65) Prior Publication Data

US 2012/0263502 A1 Oct. 18, 2012

(30) Foreign Application Priority Data

Apr. 15, 2011 (JP) ..... 2011-090697

(51) Int. Cl.
*G03G 15/08* (2006.01)

(52) U.S. Cl.
CPC ..... *G03G 15/0865* (2013.01); *G03G 15/0839* (2013.01); *G03G 15/0877* (2013.01); *G03G 15/0893* (2013.01); *G03G 2215/0668* (2013.01); *G03G 2215/0685* (2013.01); *G03G 2215/0692* (2013.01); *G03G 2215/0822* (2013.01); *G03G 2215/0827* (2013.01); *G03G 2215/0838* (2013.01); *G03G 2215/085* (2013.01)
USPC ..... 399/255; 399/120; 399/224; 399/262; 399/263

(58) Field of Classification Search
USPC ..... 399/119, 120, 224, 255, 258, 262, 263
See application file for complete search history.

(56) References Cited

U.S. PATENT DOCUMENTS

| | | | | |
|---|---|---|---|---|
| 3,883,240 | A * | 5/1975 | Ito et al. | 399/116 |
| 4,937,625 | A * | 6/1990 | Kato et al. | 399/258 |
| 5,166,732 | A | 11/1992 | Fuji | |
| 2007/0122203 | A1 | 5/2007 | Sugimoto et al. | |
| 2008/0166143 | A1 | 7/2008 | Watanabe et al. | |
| 2009/0257783 | A1 | 10/2009 | Hatakeyama et al. | |
| 2010/0272476 | A1 | 10/2010 | Shima et al. | |
| 2011/0064482 | A1 | 3/2011 | Ishiguro et al. | |

FOREIGN PATENT DOCUMENTS

| | | |
|---|---|---|
| JP | 7-104569 | 4/1995 |
| JP | 2005-346116 | 12/2005 |
| JP | 2006-171037 | 6/2006 |
| JP | 2010-66581 | 3/2010 |

* cited by examiner

*Primary Examiner* — David Gray
*Assistant Examiner* — Thomas Giampaolo, II
(74) *Attorney, Agent, or Firm* — Gerald E. Hespos; Michael J. Porco; Matthew T. Hespos

(57) ABSTRACT

An image forming apparatus includes an image bearing member, a developing apparatus and a toner container which replenishes the developing apparatus with toner. The developing apparatus includes a first conveyance member having a first rotational shaft and a toner replenishment port. The toner container includes a second conveyance member having a second rotational shaft and a toner discharge port. The developing apparatus and the toner container are assembled in such a manner that the first rotational shaft and the second rotational shaft are in mutually perpendicular directions, and the toner replenishment port and the toner discharge port are mutually overlapping in a vertical direction. The second conveyance member rotates in a direction whereby the toner is discharged from the toner discharge port to the toner replenishment port at a position on an upstream side of the toner replenishment port in terms of the toner conveyance direction.

4 Claims, 7 Drawing Sheets

FIG. 10

| | DIRECTION OF ROTATION OF THIRD CONVEYANCE SCREW | WIDTH OF TONER REPLENISHMENT PORT [mm] | THE WEIGHT OF TONER INSIDE THE DEVELOPING APPARATUS [g] | PRESENCE OR ABSENCE OF TONER WALL |
|---|---|---|---|---|
| EXAMPLE 1 | FORWARD ROTATION | 10 | 40 | ABSENCE |
| EXAMPLE 2 | FORWARD ROTATION | 16 | 67 | ABSENCE |
| COMPARATIVE EXAMPLE 1 | REVERSE ROTATION | 10 | 10 | PRESENCE |
| COMPARATIVE EXAMPLE 2 | REVERSE ROTATION | 16 | 15 | PRESENCE |

IMAGE FORMING APPARATUS

This application is based on Japanese Patent Application No. 2011-090697, filed on Apr. 15, 2011, the contents of which are hereby incorporated by reference into the present application.

BACKGROUND

The present disclosure relates to an electrophotographic type of image forming apparatus.

An image forming apparatus of an electrophotographic type, such as a copying machine or a facsimile device includes a developing apparatus which supplies toner to a photosensitive drum, which is an image bearing member, and a toner container which accommodates toner to be supplied to the developing apparatus. The developing apparatus has a developing roller onto which toner to be supplied to the photosensitive drum is deposited by static electricity, and a screw which circulates the toner to the developing roller while agitating the toner. The toner container has an accommodating section for accommodating toner, and conveyance means for conveying toner from the accommodating section to the developing apparatus. The developing apparatus is replenished with toner from the toner container by aligning and assembling a toner replenishment port situated on a developing apparatus side, with a toner discharge port on a toner container side.

There is a conventional developing apparatus in which a restricting section for locally restricting the toner conveyance capacity is provided in the screw, in order to adjust the toner replenishment volume. In the case of this developing apparatus, a region of toner retention caused by the restricting section may reach to the toner replenishment port. If toner is replenished from a toner replenishment port in this state, then the retained toner is pushed and compacted and a toner wall, which is an agglomeration of toner, is liable to form along the periphery of the screw. When the toner replenishment port is blocked off by the toner wall thus formed, then the toner is not supplied normally to the developing apparatus and the toner volume inside the developing apparatus declines. Therefore, thinning occurs in the image, giving rise to decline in the printing quality.

The object of the present disclosure is to provide an image forming apparatus which prevents formation of a toner wall in the toner replenishment port and achieves stabilization of toner replenishment.

SUMMARY

The image forming apparatus relating to one aspect of the present disclosure includes: an image bearing member which carries a toner image on a circumferential surface thereof; a developing apparatus which supplies toner to the circumferential surface of the image bearing member; and a toner container which replenishes the developing apparatus with toner. The developing apparatus includes: a toner bearing member which carries toner; a first conveyance member which conveys the toner while agitating the toner and has a first rotational shaft and a agitating blade, disposed on an outer circumference of the first rotational shaft, and rotating in unison with the first rotational shaft; a housing which accommodates the toner bearing member and the first conveyance member and includes a ceiling plate that is disposed above the first conveyance member and extends in a direction of the first rotational shaft to cover the first conveyance member; and a toner replenishment port provided in the ceiling plate, for receiving toner onto the first conveyance member. The toner container includes: a toner accommodating unit which accommodates toner to be replenished into the developing apparatus; a second conveyance member which conveys toner accommodated in the toner accommodating unit, and which has a second rotational shaft and a conveyance blade, disposed on an outer circumference of the second rotational shaft, and rotating in unison with the second rotational shaft; and a toner discharge port for discharging toner that has been conveyed via the second conveyance member, towards the toner replenishment port. The developing apparatus and the toner container are assembled in such a manner that the first rotational shaft and the second rotational shaft are in mutually perpendicular directions, and the toner replenishment port and the toner discharge port are mutually overlapping in a vertical direction. The second conveyance member rotates in a direction whereby the toner is discharged from the toner discharge port to the toner replenishment port at a position on an upstream side of the toner replenishment port in terms of the toner conveyance direction by the first conveyance member.

BRIEF DESCRIPTION OF THE DRAWINGS

FIG. 10 is a diagram in tabular form showing a relationship between the weight of toner inside the developing apparatus and the presence or absence of a toner wall formed at the toner replenishment port, when the direction of rotation of the third conveyance screw and the opening width of the toner replenishment port were varied.

DETAILED DESCRIPTION

Figure 1:
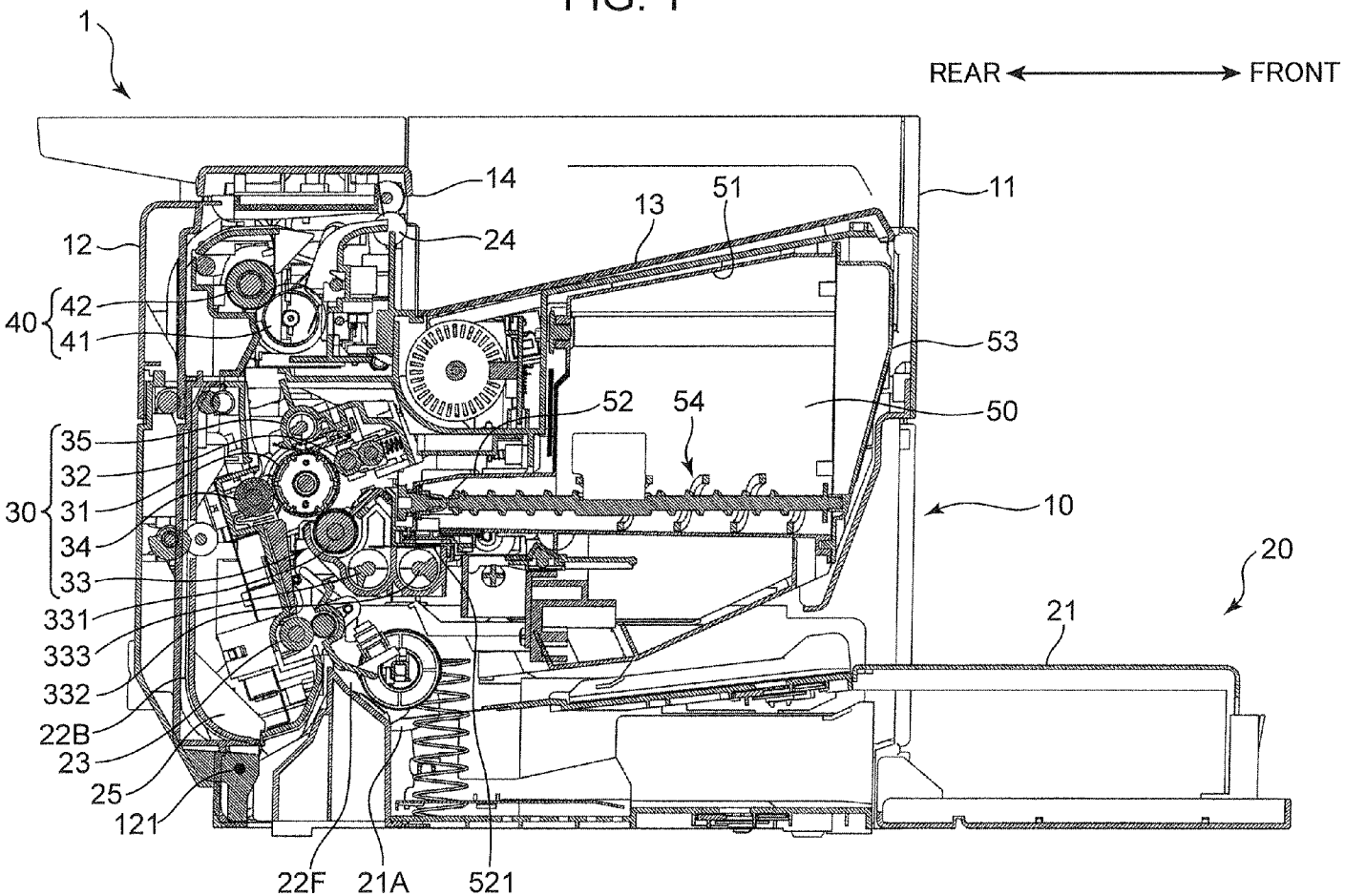
FIG. 1 is a cross-sectional drawing showing an internal structure of an image forming apparatus relating to an embodiment of the present disclosure.

Below, an embodiment of the present disclosure is described in detail here with reference to the drawings. FIG. 1 is a cross-sectional drawing showing an internal structure of an image forming apparatus 1 relating to an embodiment of the present disclosure. Here, a monochrome printer is given as an example of an image forming apparatus 1, but the image forming apparatus may also be a copying device, a facsimile device or a composite device combining the functions of these, and may also be an image forming apparatus which forms a color image.

The image forming apparatus 1 includes a main body housing 10 having a substantially parallelepiped-shaped frame structure, a sheet feed unit 20 which is accommodated inside the main body housing 10, an image forming unit 30, a fixing unit 40 and a toner container 50.

A front cover 11 is provided on the front surface side of the main body housing 10 and a rear cover 12 is provided on the rear surface side. The user is able to take out the toner container 50 from the front surface side of the main body housing 10, when the toner has run out, by opening the front cover 11. The rear cover 12 is a cover which is opened in the event of a sheet jam or during maintenance. The image forming unit 30 and the fixing unit 40 can each be taken out from the rear surface side of the main body housing 10, by opening the rear cover 12. Furthermore, a sheet output unit 13 to which sheets are output after image formation is provided on the upper surface of the main body housing 10.

The sheet feed unit 20 includes a sheet feed cassette 21 which accommodates sheets on which an image forming process is to be carried out. The sheet feed cassette 21 can be pulled out in the forward direction from the front side of the main body housing 10. A sheet accommodating space in which a stack of the sheets are accommodated, and a lifting plate which lifts up the stack of sheets in order to supply sheet, and the like, are provided in the sheet feed cassette 21. A sheet pay-out unit 21A is provided above the rear end side of the sheet feed cassette 21. A pick-up roller (not illustrated) for paying out the sheet in the uppermost layer of the stack of sheets inside the sheet feed cassette 21, one at a time, is provided in the sheet pay-out unit 21A.

The image forming unit 30 carries out an image forming process for forming a toner image on a sheet which is conveyed out from the sheet feed unit 20. The image forming unit 30 includes a photosensitive drum 31 (image bearing member), and arranged about the periphery of this photosensitive drum 31, a charging apparatus 32, an exposure apparatus (not shown in FIG. 1), a developing apparatus 33, a transfer roller 34 and a cleaning apparatus 35.

The photosensitive drum 31 rotates about a shaft thereof, and an electrostatic latent image and a toner image are formed on the circumferential surface thereof. For the photosensitive drum 31, it is possible to use a photosensitive drum employing an amorphous silicon (a-Si) material. The charging apparatus 32 includes a charging roller which uniformly charges the surface of the photosensitive drum 31 and which is abutted against the photosensitive drum 31. The exposure apparatus includes a laser light source and optical devices such as a mirror, lens, and so on, and forms an electrostatic latent image on the circumferential surface of the photosensitive drum 31 by irradiating light modulated on the basis of image data supplied from an external apparatus, such as a personal computer.

The developing apparatus 33 supplies toner to the circumferential surface of the photosensitive drum 31 in order to form a toner image by developing the electrostatic latent image on the photosensitive drum 31. The developing apparatus 33 includes a developing housing 60 (see FIG. 2 to FIG. 5), a developing roller 331 (toner bearing member) which bears toner to be supplied to the photosensitive drum 31, and a first conveyance screw 332 (first conveyance member) and a second conveyance screw 333 which circulate the developer (toner) while agitating same, are provided inside the developing housing 60. This developing apparatus 33 is described in detail below.

The transfer roller 34 is a roller for transferring a toner image formed on a circumferential surface of the photosensitive drum 31, onto a sheet, and forming a transfer nip section with the photosensitive drum 31. A transfer bias having opposite polarity to the toner is applied to the transfer roller 34. The cleaning apparatus 35 has a cleaning roller, or the like, for cleaning the circumferential surface of the photosensitive drum 31 after transfer of the toner.

The fixing unit 40 carries out a fixing process for fixing the transferred toner image onto a sheet. The fixing unit 40 includes a fixing roller 41 which has an in-built heat source, and a pressurizing roller 42 which makes pressure contact with the fixing roller 41 and forms a fixing nip section with the fixing roller 41. When the sheet to which the toner image has been transferred is passed through the fixing nip section, the toner image is fixed onto the sheet by the heating of the fixing roller 41 and the pressurization of the pressurizing roller 42.

The toner container 50 stores toner to be replenished in the developing apparatus 33. The toner container 50 includes a container main body 51 (a portion of the toner accommodating section) which is a main storage location of the toner, a tubular section 52 (a portion of the toner accommodating section) which projects from a lower part of one side surface of the container main body 51, a lid member 53 which covers another side face of the container main body 51, and a third conveyance screw 54 (second conveyance member) which conveys toner accommodated inside the container. The toner stored inside the toner container 50 is supplied to the interior of the developing apparatus 33 from a toner discharge port 521 provided on a lower face of a front end of the tubular section 52, by the rotational driving of the third conveyance screw 54. This toner container 50 is described in detail below.

In order to convey a sheet, a main conveyance path 22F and a reverse conveyance path 22B are provided inside the main body housing 10. The main conveyance path 22F extends from a sheet pay-out unit 21A of the sheet feed unit 20, via the image forming unit 30 and the fixing unit 40, to the sheet output port 14 which is provided to oppose to the sheet output unit 13 on the upper surface of the main body housing 10. The reverse conveyance path 22B is a conveyance path for returning a sheet which has been printed on one surface, to an upstream side of the image forming unit 30 in the main conveyance path 22F, when performing double-side printing on the sheet.

A resist roller pair 23 is arranged on the upstream side of the main conveyance path 22F from the transfer nip section of the photosensitive drum 31 and the transfer roller 34. The sheet is halted temporarily at the resist roller pair 23, and the sheet is corrected for skew and then sent out to the transfer nip section at a prescribed timing for image transfer. A plurality of conveyance rollers for conveying sheets are arranged at suitable positions in the main conveyance path 22F and the return conveyance path 22B and a sheet output roller pair 24 is arranged in the vicinity of the sheet output port 14, for example.

The reverse conveyance path 22B is formed between the outer surface of an inverting unit 25, and the inner surface of a rear cover 12 of the main body housing 10. One roller of the transfer roller 34 and the resist roller pair 23 is installed on the inner surface of the inverting unit 25. The rear cover 12 and the inverting unit 25 are able to rotate respectively about fulcrum points 121 which are provided on the lower ends thereof. If a sheet jam has occurred in the reverse conveyance path 22B, then the rear cover 12 is opened. If a sheet jam has occurred in the main conveyance path 22F, or if the unit of the photosensitive drum 31 or the developing apparatus 33 is to be removed externally, then the inverting unit 25 is opened in addition to the rear cover 12.

Figure 2:
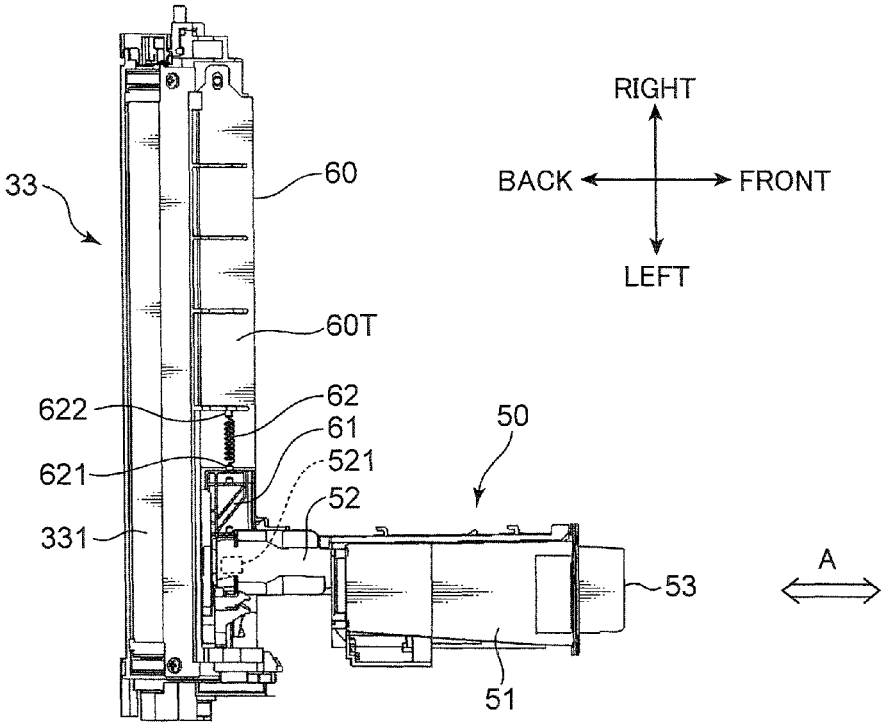
FIG. 2 is a plan diagram showing a developing apparatus and a toner container which are incorporated into an image forming apparatus.
Figure 3:
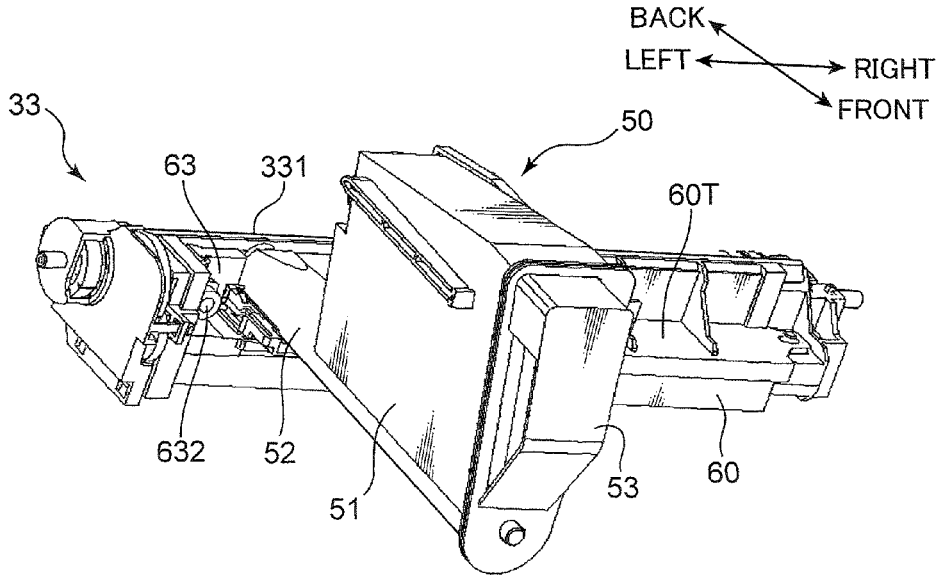
FIG. 3 is a perspective diagram of a developing apparatus and a toner container shown in FIG. 2.
Figure 4:
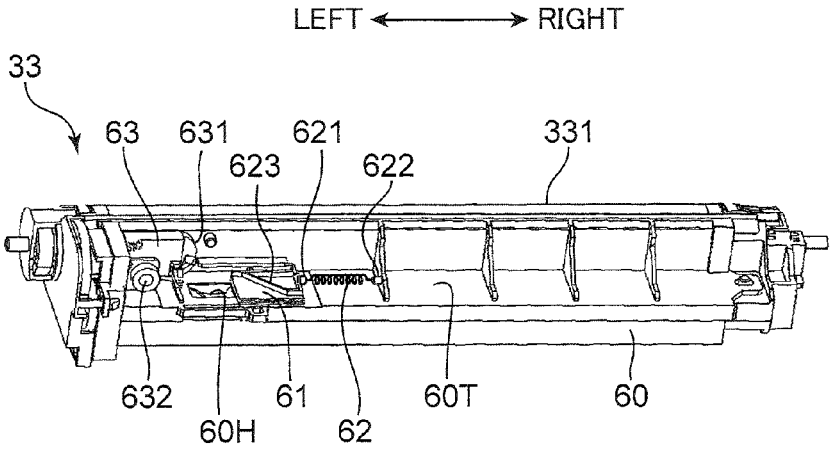
FIG. 4 is a perspective diagram of a developing apparatus alone.
Figure 5:
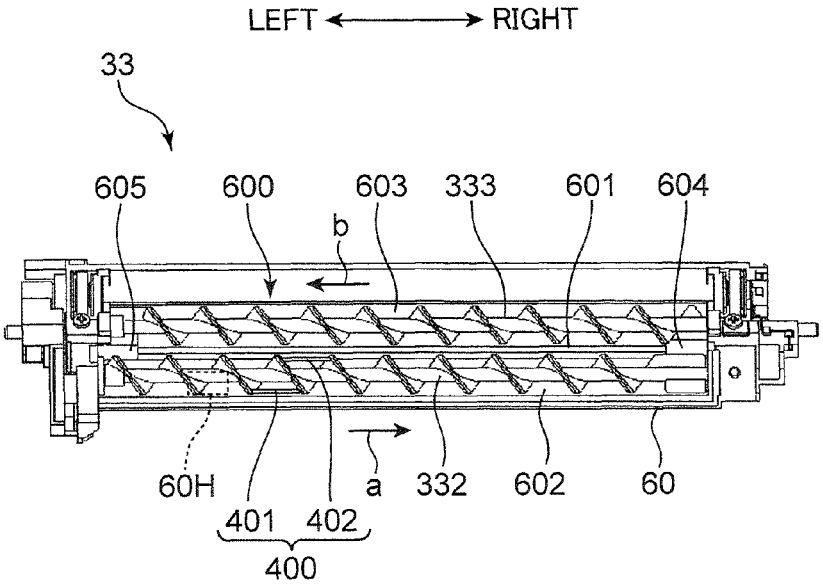
FIG. 5 is a plan diagram showing an internal structure of a developing apparatus.
Figure 6:
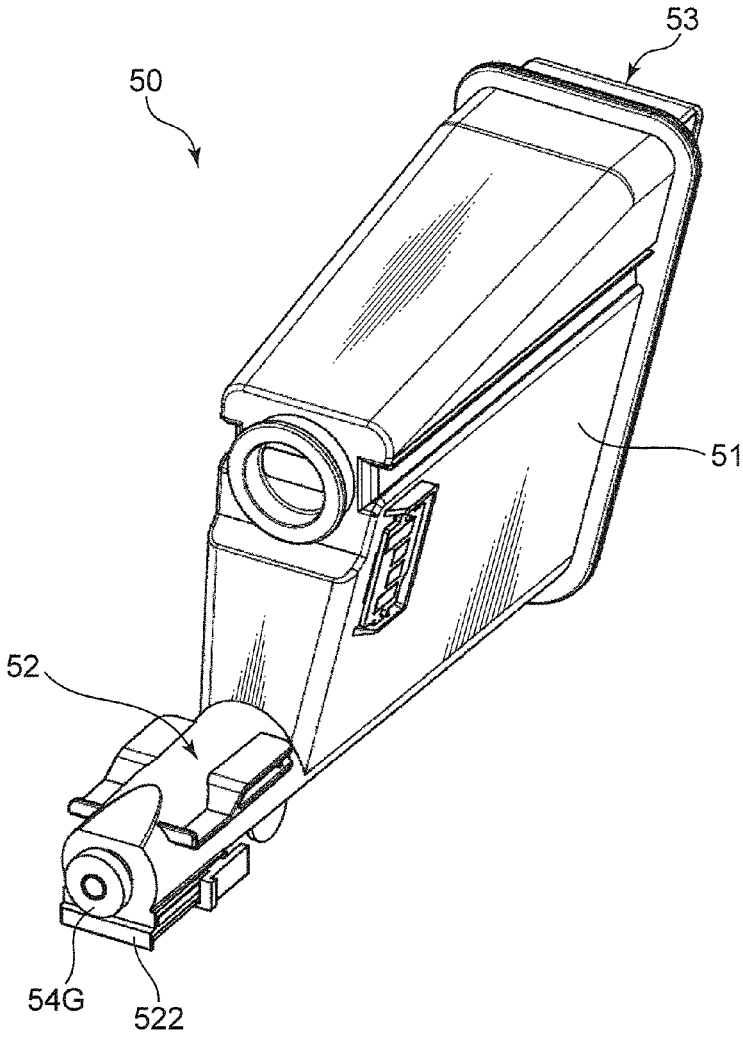
FIG. 6 is a perspective diagram of a toner container alone.
Figure 7:
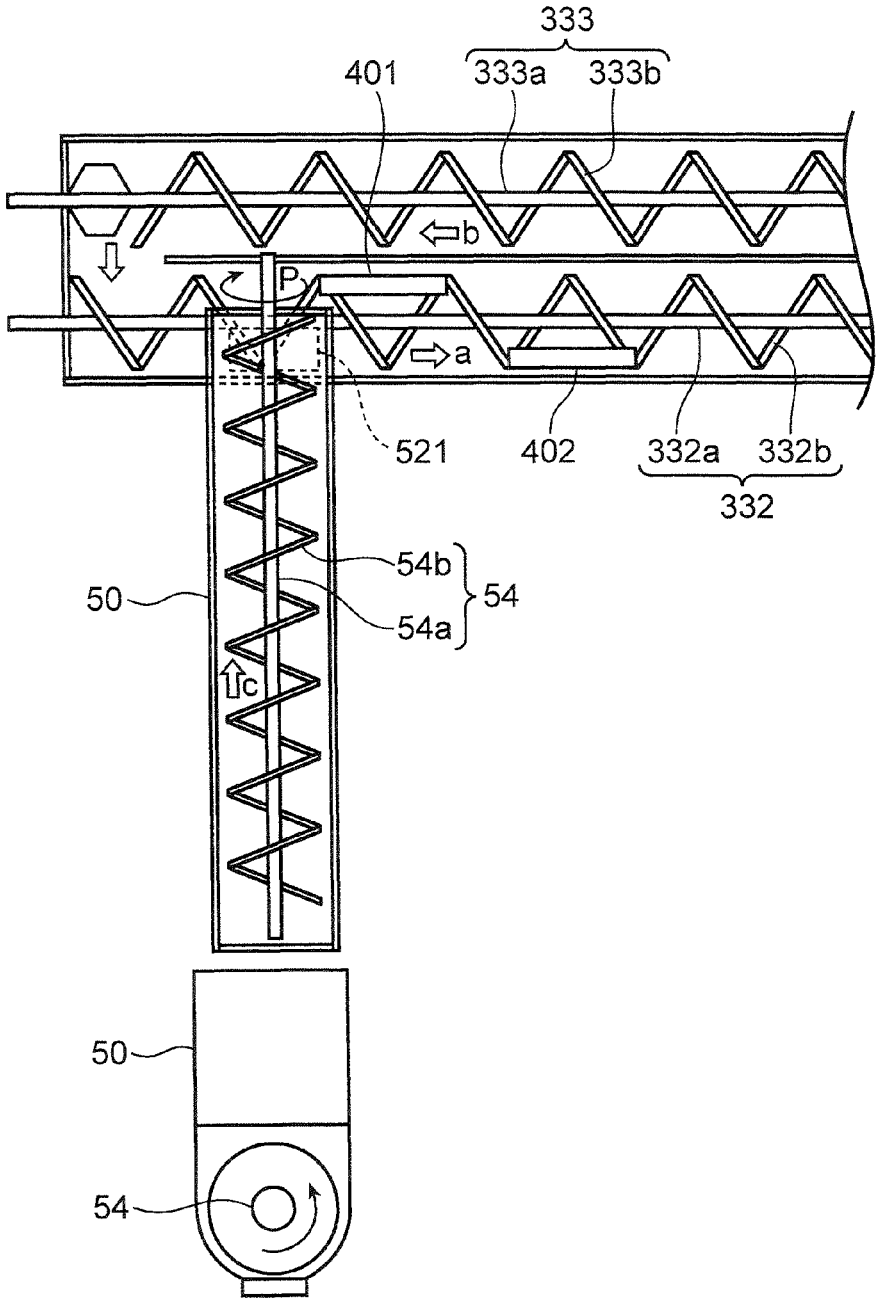
FIG. 7 is a plan diagram showing an approximate view of an internal structure when a developing apparatus and toner container are in an assembled state.

Next, the structure of the developing apparatus 33 and the toner container 50, and the positional relationship thereof will be explained with reference to FIG. 2 to FIG. 7. FIG. 2 is a plan view showing an assembled state of a developing apparatus 33 and a toner container 50, FIG. 3 is a perspective diagram of same, FIG. 4 is a perspective diagram of the developing apparatus 33 alone, FIG. 5 is a plan diagram showing an internal structure of the developing apparatus 33, FIG. 6 is a perspective diagram of the toner container 50 alone, and FIG. 7 is a plan diagram showing a schematic view of the internal structure of the developing apparatus 33 and the toner container 50 in an assembled state.

The developing apparatus 33 includes a developing housing 60 (housing) having a box shape which is long in one direction (the axial direction of the developing roller 331). The developing housing 60 is formed with an opening section which extends in the lengthwise direction, thereby exposing a portion of the circumferential surface of the developing roller 331 via this opening section. In the present embodiment, the developing housing 60 is assembled on the main body housing 10 in such a manner that the lengthwise direction thereof coincides with the left/right direction of the main body housing 10.

The developing housing 60 accommodates a developing roller 331, and first and second conveyance screws 332, 333. The developing housing 60 includes a ceiling plate 60T which is arranged above the first conveyance screw 332 in the axial direction thereof, and which covers the first conveyance screw 332.

A toner replenishment port 60H for receiving toner supplied from the toner container 50, inside the housing, is opened in the ceiling plate 60T in the vicinity of the left end of the developing housing 60. The developing apparatus 33 and the toner container 50 are assembled in such a manner that the toner replenishment port 60H and the toner discharge port 521 of the toner container 50 are mutually superimposed in the vertical direction. As indicated by the arrow A in FIG. 2, the toner container 50 is attached to and detached from the developing apparatus 33, in a direction perpendicular to the lengthwise direction of the developing housing 60 (the front/rear direction). The toner container 50 includes a housing shape which is long in one direction in plan view, and therefore forms a substantially L-shaped structure in plan view, when the toner container 50 is installed on the developing apparatus 33 (see FIG. 2).

A developing shutter plate 61 which can slide in the left/right direction is provided on the upper surface of the ceiling plate 60T. The developing shutter plate 61 is biased in the leftward direction at all times by an biasing spring 62. The biasing spring 62 is a coil spring, the respective end portions of which are installed on spring seatings 621, 622 provided respectively on a right end edge of the developing shutter plate 61 and a rib which is adjacent to the developing shutter plate 61. FIG. 4 shows a state where the toner replenishment port 60H is opened, but when the toner container 50 is not yet fitted, the developing shutter plate 61 is biased by the biasing spring 62 and positioned on the left side, thereby shutting off the toner replenishment port 60H.

A pressing plate 522 is installed on the lower part of the front end edge of the tubular section 52 of the toner container 50. Furthermore, a container gear 54G for inputting rotational drive force to the third conveyance screw 54 is provided in exposed fashion on the front end surface of the tubular section 52. A gear holder 63 including an input gear 631 and a coupling 632 is disposed in the left inner part of the toner replenishment port 60H of the developing housing 60. A rotational drive force from a motor (not illustrated) which is provided in the main body housing 10 is applied to the coupling 632. The input gear 631 meshes with a container gear 54G when the toner container 50 is in an installed state on the developing apparatus 33, and transmits the rotational drive force to the container gear 54G.

When the toner container 50 is installed in the developing apparatus 33, the tubular section 52 of the toner container 50 is inserted into the toner replenishment port 60H towards the rear from the front side. In this case, the pressing plate 522 of the toner container 50 interferes with the developing shutter plate 61 in a state where the toner replenishment port 60H is closed off, and the developing shutter plate 61 moves rightwards. More specifically, slanted projecting ribs 623 which are provided so as to project from the upper surface of the developing shutter plate 61 interfere with the pressing plate 522, and the developing shutter plate 61 is pushed aside to the right against the biasing force of the biasing spring 62. When the tubular section 52 of the toner container 50 enters to a prescribed position, the toner replenishment port 60H is fully opened and the input gear 631 and the container gear 54G mesh with each other.

Referring to FIG. 5, the developing housing 60 includes an internal space 600. In the case of a one-component developing method, toner is filled into the internal space 600 as a developer. The toner is agitated and conveyed inside the internal space 600, and is consumed by being supplied gradually to the developing roller 331. Toner corresponding to the consumed amount is supplied appropriately from the toner container 50.

The internal space 600 of the developing housing 60 is divided into a first channel 602 and a second channel 603 which are long in the left/right direction, by a dividing plate 601 which extends in the left/right direction. The dividing plate 601 is shorter than the width of the developing housing 60 in the left/right direction, and a first connecting section 604 and a second connecting section 605 which are respectively connected to the first channel 602 and the second channel 603 are provided at the right end and left end of the dividing plate 601. By this means, a circulation channel from the first channel 602, to the first connecting section 604, to the second channel 603 and to the second connecting section 605 is formed inside the developing housing 60.

The toner replenishment port 60H described above is situated above the vicinity of the left end of the first channel 602. The first conveyance screw 332 is accommodated in the first channel 602, and the second conveyance screw 333 is accommodated in the second channel 603. The first conveyance screw 332 includes a rotational shaft 332*a* (first rotational shaft) and a blade member 332*b* (agitating blade) which rotates in unison with the rotational shaft 332*a* and projects in a spiral fashion on the outer circumference of the rotational shaft 332*a* (see FIG. 7 to FIG. 9). Similarly, the second conveyance screw 333 includes a rotational shaft 333*a* and a blade member 333*b*. The first conveyance screw 332 conveys developer in the direction of arrow a in FIG. 5, by being driven to rotate about the rotational shaft. On the other hand, the second conveyance screw 333 conveys developer in the direction of arrow b, by being driven to rotate about the rotational shaft.

By driving the first and second conveyance screws 332, 333 to rotate, toner is conveyed and circulated along the circulation path described above. To describe toner which is newly replenished from the toner replenishment port 60H, the toner drops down into the first channel 602, mixes with the existing toner and is conveyed in the direction of arrow a by the first conveyance screw 332. In this case, the toner is agitated and becomes electrically charged. Thereupon, the toner passes from the downstream end of the first channel 602, along the first connecting section 604, enters into the second channel 603, and is conveyed in the direction of arrow b by the second conveyance screw 333. In this course of this conveyance, the toner becomes charged in the same manner, while a part of the toner is supplied to the circumferential surface of the developing roller 331. The remaining toner passes along the second connecting section 605 and is returned to the upstream end of the first channel 602.

A conveyance capacity restricting section 400 is provided in the first conveyance screw 332, at a position immediately next to the toner replenishment port 60H, on the downstream side of the toner replenishment port 60H in terms of the toner conveyance direction. The conveyance capacity restricting section 400 is constituted by a plurality of restricting rods 401 and 402, which are provided in parallel with the rotational shaft in the peripheral edge area of the blade member of the first conveyance screw 332. In the present embodiment, the conveyance capacity restricting section 400 is described as restricting rods 401 and 402, but the number of restricting rods is not limited to this.

By providing this conveyance capacity restricting section 400, the forward travel of the toner conveyed along the first channel 602 in the direction of arrow a is obstructed by the restricting rods 401 and 402 upon arriving at the conveyance capacity restricting section 400, and hence the toner is retained. Consequently, when the amount of toner inside the developing housing 60 increases due to replenishment of toner, this retained toner acts so as to close off the toner replenishment port 60H, and further replenishment of toner is restricted. Thereupon, as the toner is consumed and the retained toner becomes less, the toner that has been closing off the toner replenishment port 60H decreases and the toner starts to be replenished again. The conveyance capacity restricting section 400 may employ a mode other than one based on addition of restricting rods, and it is also possible to decrease the toner conveyance capacity by reducing the diameter of the blade member, for example, compared to other portions.

Next, the detailed structure of the toner container 50 will be described. The toner container 50 includes a container main body 51 which is a main storage location of toner that is replenished to the developing apparatus 33, a tubular section 52 which projects from the lower part of one side surface of the container main body 51, a lid member 53 which covers another side face of the container main body 51, and a third conveyance screw (second conveyance member) which is provided throughout the lower part of the container main body 51 and the tubular section 52, and which conveys toner accommodated inside the container.

A container gear 54G which is coupled to the third conveyance screw 54 is disposed on the front end surface of the tubular section 52. The container gear 54G meshes with the input gear 631 when the toner container 50 is installed in the developing apparatus 33, the rotational drive force from the input gear 631 is transmitted thereto, and the third conveyance screw 54 is caused to rotate in the direction of arrow P in FIG. 7. The third conveyance screw 54 includes a rotational shaft 54*a* (second rotational shaft) and a blade member 54*b* (conveyance blade) provided so as to project in a spiral fashion on the circumference of the rotational shaft 54*a*.

By rotating the third conveyance screw 54 in the direction of arrow P, the toner which is stored inside the container main body 51 is conveyed in the direction of arrow c in FIG. 7, in other words, towards the toner discharge port 521. The toner discharge port 521 discharges toner which has been conveyed by the third conveyance screw 54 and is provided on the lower surface of the front end of the tubular section 52. This toner discharge port 521 is installed so as to overlap with the toner replenishment port 60H in the vertical direction, and therefore the toner conveyed in the direction of arrow c passes from the toner discharge port 521 to the toner replenishment port 60H and enters into the developing housing 60.

Figure 8:
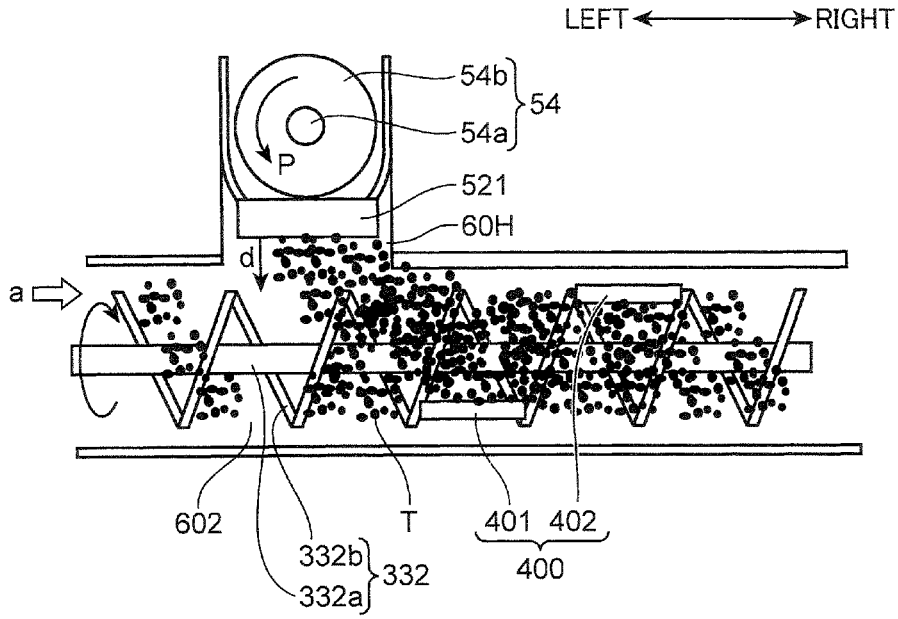
FIG. 8 is a cross-sectional diagram of a developing apparatus and a toner container in a direction perpendicular to the axis of rotation of a third conveyance screw (second conveyance member)

FIG. 8 is a cross-sectional diagram of the toner container 50 and the developing housing 60 in a direction perpendicular to the rotational shaft 54*a* of the third conveyance screw 54. As shown in FIG. 8, the toner container 50 is assembled on the developing apparatus 33 in such a manner that the rotational shaft 332*a* of the first conveyance screw 332 and the rotational shaft 54*a* of the third conveyance screw 54 are arranged in mutually perpendicular directions. Since the toner container includes a container main body 51 and a tubular section 52 which projects from the container main body 51, and a toner discharge port 521 is provided in the tubular section 52, then it is possible to carry out assembly in perpendicular directions, easily.

The flow of toner is described in detail with reference to FIG. 8. As described above, when the amount of toner inside the developing housing 60 increases, the toner T is retained in the vicinity of the conveyance capacity restricting section 400. The retained toner T starts to close off the toner replenishment port 60H. At this time, the toner T starts to block off the downstream side portion of the opening range of the toner replenishment port 60H, in terms of the toner conveyance direction in the first channel 602.

In a state where a portion of the toner replenishment port 60H is closed off by the toner T in this way, when further toner is discharged from the toner discharge port 521, this discharged toner pushes and compacts the toner T which is closing off the toner replenishment port 60H. In this compacted portion, a toner wall of agglomerated toner T is formed about the periphery of the first conveyance screw 332 (along the inner wall of the developing housing 60). The toner wall which is formed by this compacted toner forms an obstacle to toner replenishment to the toner replenishment port 60H. Consequently, the amount of toner in the developing housing 60 gradually declines, and a state of toner insufficiency arises. Consequently, thinning occurs in the image, and this has given rise to decline in the printing quality.

Therefore, in the present embodiment, the toner which is discharged from the toner container 50 is replenished from an upstream side position in the toner replenishment port 60H in terms of the toner conveyance direction in the first channel 602 (the position indicated by arrow d in FIG. 8). Therefore, as shown in FIG. 8, if the toner conveyance direction in the first channel 602 is a direction from left to right along the direction of extension of the rotational shaft 332*a*, as indicated by arrow a, then the rotational shaft 54*a* is rotated in a counter-clockwise direction (the direction of arrow P), in a cross-sectional view perpendicular to the rotational shaft 54*a* of the third conveyance screw 54. Due to the rotational shaft 54*a* rotating in the direction of arrow P, the blade member 54*b* which is attached to the rotational shaft 54*a* rotates in the direction of arrow P, and the toner drops down from the upstream side position at arrow d in the toner replenishment port 60H in terms of the toner conveyance direction in the first channel 602. By adopting this composition, even if the toner T is retained by the conveyance capacity restriction unit 400 and closes off the toner replenishment port 60H from the downstream side in terms of the toner conveyance direction in the first channel 602, it is still possible to replenish toner from the upstream side of the toner replenishment port 60H, and the amount of toner in the developing housing 60 can be stabilized.

Figure 9:
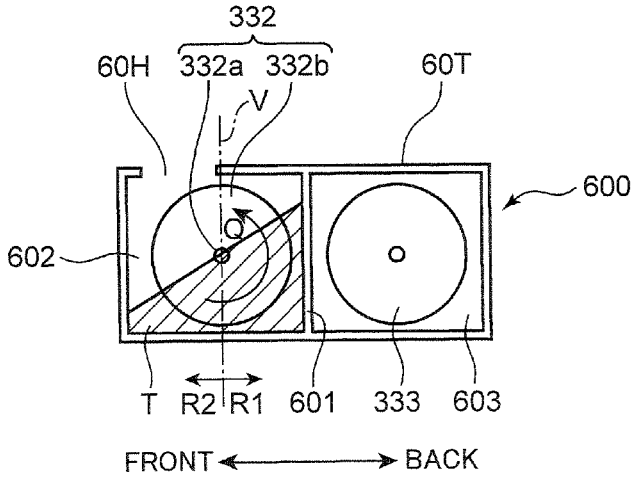
FIG. 9 is a cross-sectional diagram of a developing housing in a direction perpendicular to the axis of rotation of a first conveyance screw (first conveyance member)

Furthermore, in the developing apparatus 33 according to the present embodiment, the position of the toner replenishment port 60H is also improved. FIG. 9 is a cross-sectional diagram of a developing housing 60 in a direction which is perpendicular to the rotational shaft 332*a* of the first conveyance screw 332. Here, in a cross-sectional view perpendicular to the rotational shaft 332*a*, the agitating region of the blade member 332*b* is divided into a first region R1 where the blade member 332*b* rotates from bottom to top and a second region R2 where the blade member 332*b* rotates from top to bottom, on either side of a vertical line V which passes through the rotational shaft 332*a*.

When the rotational shaft 332*a* of the first conveyance screw 332 rotates in the direction of arrow Q, the toner in the region towards the rear of the first channel 602 (the first region R1) is agitated from bottom to top by the attached blade member 332*b*. On the other hand, the toner in the region towards the front of the first channel 602 (the second region R2) is agitated from top to bottom and is moved towards the first region R1 of the first channel 602. In other words, as shown in FIG. 9, the toner in the first channel 602 accumulates with a gradient whereby the toner is high in the first region R1 of the first channel 602 and low in the second region R2 of the first channel 602.

In this way, since the toner accumulates in the first channel 602 so as to be high in the first region R1 and low in the second region R2, then when toner is replenished from the toner replenishment port 60H, on the side of the first region R1 of the first channel 602, then this toner is further added to a position where the toner has accumulated to a large height. In a replenishment mode of this kind, the toner is compacted in the vicinity of the toner replenishment port 60H and causes the formation of a toner wall. Therefore, in the present embodiment, the toner replenishment port 60H is provided at a position towards the front of the first channel 602, in other words, in the ceiling plate 60T above the second region R2 where the blade member 332*b* rotates from top to bottom, in a cross-sectional view perpendicular to the rotational shaft 332*a* of the first conveyance screw 332. By adopting a composition of this kind, toner is replenished from the toner replenishment port 60H to a position where the toner accumulates to a low height in the first channel 602, thereby preventing the formation of a toner wall and making it possible to replenish toner in a stable fashion.

FIG. 10 is a diagram in tabular form showing a relationship between the weight of the toner inside the developing apparatus 33 and the presence or absence of a toner wall formed at the toner replenishment port 60H, when the direction of rotation of the third conveyance screw 54 and the opening width of the toner replenishment port 60H were varied. In terms of the direction of rotation of the third conveyance screw 54, forward rotation (Examples 1 and 2) means a direction of rotation whereby toner drops down on the upstream side of the toner replenishment port 60H (the arrow d in FIG. 8) in terms of the toner conveyance direction in the first channel 602, and reverse rotation (Comparative Examples 1 and 2) means a direction of rotation whereby toner drops down on the downstream side of the toner replenishment port 60H in terms of the toner conveyance direction in the first channel 602.

The examples and the comparative examples respectively confirmed cases where the outer diameter of the tubular section 52 of the toner container 50 was 14 mm, and the opening width of the toner replenishment port 60H was 10 mm, which is smaller than the outer diameter (Example 1 and Comparative Example 1), or 16 mm, which is larger than the outer diameter (Example 2 and Comparative Example 2). This opening width indicates the length in the left/right direction (the lengthwise direction of the developer housing 60) of the toner replenishment port 60H. If the opening width of the toner replenishment port 60H is smaller than the outer diameter of the tubular section 52, a toner wall is liable to occur due to the conveyance pressure created by the first conveyance screw 332 and the pressure generated when the toner drops down from the toner discharge port 521.

The amount of toner inside the developing apparatus 33 is 40 g to 60 g in a normal printing mode. When a toner wall is formed due to the toner replenishment port 60H being closed off by toner, then this presents an obstacle to the supply of toner to the developing apparatus 33, and the amount of toner inside the developing apparatus 33 declines. Thinning of the image occurs when the amount of toner inside the developing apparatus 33 becomes 20 g or lower.

When the direction of rotation of the third conveyance screw 54 was forward rotation and the opening width of the toner replenishment port 60H was 10 mm, as in the case of Example 1, the amount of toner inside the developing apparatus 33 was 40 g, and a toner wall was not formed in the toner replenishment port 60H. Furthermore, thinning of the image did not occur.

When the direction of rotation of the third conveyance screw 54 was forward rotation and the opening width of the toner replenishment port 60H was 16 mm, as in the case of Example 2, the amount of toner inside the developing apparatus 33 was 67 g, and a toner wall was not formed in the toner replenishment port 60H. Furthermore, thinning of the image did not occur. However, it can be seen that a somewhat excessive amount of toner is supplied since the amount of toner inside the developing apparatus 33 exceeds the amount of toner during a normal printing state, of 40 g to 60 g.

When the direction of rotation of the third conveyance screw 54 was reverse rotation and the opening width of the toner replenishment port 60H was 10 mm, as in the case of Comparative Example 1, the amount of toner inside the developing apparatus 33 was 10 g, and a toner wall formed in the toner replenishment port 60H. Furthermore, thinning of the image also occurred. Moreover, when the direction of rotation of the third conveyance screw 54 was reverse rotation and the opening width of the toner replenishment port 60H was 16 mm, as in the case of Comparative Example 2, the amount of toner inside the developing apparatus 33 was 15 g, and a toner wall formed in the toner replenishment port 60H. Furthermore, thinning of the image also occurred.

As shown in Comparative Examples 1 and 2, making the direction of rotation of the third conveyance screw 54 a reverse direction means replenishing toner from the downstream side of the toner replenishment port 60H in terms of the toner conveyance direction in the first channel 602. In this case, if the toner is retained by the conveyance capacity restricting section 400 and this retaining toner closes off the toner replenishment port 60H from the downstream side in the toner conveyance direction, then replenishment of toner is not carried out and therefore the amount of toner inside the developing apparatus 33 decreases. It can be seen that this point was confirmed by Comparative Examples 1 and 2. From the foregoing, it can be seen that the conditions in Example 1 enable the most stable replenishment of toner.

As described above, in the present embodiment, the toner conveyance direction in the first channel 602 is one direction following the direction of extension of the rotational shaft 332*a* (the arrow a in FIG. 8). The rotational shaft 54*a* is rotated in such a manner that the direction of movement of the lower half region of the circumferential surface of the rotational shaft 54*a* follows the toner conveyance direction and the direction of movement of the upper half region is the opposite direction to the toner conveyance direction (a counter-clockwise direction), in a cross-sectional view perpendicular to the rotational shaft 54*a* of the third conveyance screw 54. By this means, it is possible to make toner drop down from the upstream side of the toner replenishment port 60H in terms of the toner conveyance direction in the first channel 602. Consequently, even if toner which has been retained by the conveyance capacity restricting section 400 closes off the toner replenishment port 60H from the downstream side of the toner conveyance direction in the first channel 602, it is possible to replenish toner from the upstream side of the toner replenishment port 60H in the toner conveyance direction. In other words, it is possible to ensure a toner replenishment path to the developing apparatus 33, and toner replenishment to the developing apparatus 33 can be performed in a stable fashion.

Moreover, the toner replenishment port 60H is provided in a position of the ceiling plate 60T on a side distant from the second channel 603, in other words, on the ceiling plate 60T above the second region R2 where the blade member 332*b* rotates from top to bottom, in a cross-sectional view which is perpendicular to the rotational shaft 332*a* of the first conveyance screw 332. By this means, it is possible to replenish toner to a position where the toner is accumulated to a low height in the first channel 602, thereby avoiding compaction of the toner and formation of a toner wall, and hence toner replenishment can be performed in a stable fashion.

As described above, according to the present disclosure, it is possible to prevent the formation of a toner wall in the vicinity of the toner replenishment port 60H, and the developing apparatus can be replenished with toner from the toner container in a stable fashion without employing any extra apparatus. Consequently, it is possible to prevent the occurrence of thinning of the image due to decrease in the toner inside the developing apparatus 33, and the like, and an image forming apparatus 1 capable of performing high-quality image formation can be provided.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

an image bearing member which carries a toner image on a circumferential surface thereof;

a developing apparatus which supplies toner to the circumferential surface of the image bearing member; and a toner container which replenishes the developing apparatus with toner;

wherein the developing apparatus includes:

a toner bearing member which carries toner;

a first conveyance member which conveys the toner while agitating the toner and has a first rotational shaft and a agitating blade, disposed on an outer circumference of the first rotational shaft, and rotating in unison with the first rotational shaft;

a housing which accommodates the toner bearing member and the first conveyance member and includes a ceiling plate that is disposed above the first conveyance member and extends in a direction of the first rotational shaft to cover the first conveyance member;

a toner replenishment port provided in the ceiling plate, for receiving toner onto the first conveyance member, and a first gear provided on the ceiling plate and near the toner replenishment port for transmitting a rotational drive force the toner container includes:

a toner accommodating unit which accommodates toner to be replenished into the developing apparatus, the toner accommodating unit including a container main body that is a main storage location for the toner and a tubular section that projects from a lower part of one side surface of the container main body;

a second conveyance member which conveys toner accommodated in the toner accommodating unit, and which has a second rotational shaft and a conveyance blade, disposed on an outer circumference of the second rotational shaft, and rotating in unison with the second rotational shaft;

a toner discharge port for discharging toner that has been conveyed via the second conveyance member, towards the toner replenishment port, the toner discharge port being provided in the tubular section, and a second gear disposed on a front end surface of the tubular section and connected to the second conveyance member, the developing apparatus and the toner container are assembled in such a manner that the first rotational shaft and the second rotational shaft are in mutually perpendicular directions, and the toner replenishment port and the toner discharge port are mutually overlapping in a vertical direction, and the second gear meshes with the first gear when the toner container is installed in the developing apparatus, the toner replenishment port has an upstream side portion and a downstream side portion in an opening range thereof in a toner conveyance direction by the first conveyance member;

the agitating blade has a conveyance capacity restricting section for locally restricting a conveyance capacity of the toner, on a downstream side of the toner replenishment port in terms of the toner conveyance direction, the conveyance capacity restricting section being a member that causes the toner retained by the conveyance capacity restricting section to start to restrict the movement of the toner at the downstream side portion of the toner replenishment port; and the first gear causes the second conveyance member to rotates in a direction whereby the toner is discharged from the toner discharge port to the toner replenishment port at a position on the upstream side portion of the toner replenishment port.

2. The image forming apparatus according to claim 1, wherein the conveyance direction of the toner by the agitating blade is a direction from left to right in a direction of extension of the first rotational shaft, and the second rotational shaft rotates in a counter-clockwise direction, in a cross-sectional view perpendicular to the second rotational shaft.

3. The image forming apparatus according to claim 1, wherein, in a cross-sectional view perpendicular to the first rotational shaft, when a agitating region by the agitating blade is divided into a first region in which the agitating blade rotates from bottom to top and a second region in which the agitating blade rotates from top to bottom, with a vertical line passing through the first rotational shaft as a boundary, the toner replenishment port is provided on the ceiling plate above the second region.

4. The image forming apparatus according to claim 1, wherein the second conveyance member is arranged throughout the lower part of the container main body and the tubular section, and the toner discharge port is provided on a lower face of a front end of the tubular section.

* * * * *